US007106033B1

(12) United States Patent
Liu et al.

(10) Patent No.: US 7,106,033 B1
(45) Date of Patent: Sep. 12, 2006

(54) QUICK-RECOVERY LOW DROPOUT LINEAR REGULATOR

(75) Inventors: Shen-Iuan Liu, Taipei (TW); Sao-Hung Lu, Taoyuan (TW)

(73) Assignee: Sitronix Technology Corp., Hsinchu Hsien (TW)

( * ) Notice: Subject to any disclaimer, the term of this patent is extended or adjusted under 35 U.S.C. 154(b) by 0 days.

(21) Appl. No.: 11/144,643

(22) Filed: Jun. 6, 2005

(51) Int. Cl.
*G05F 1/40* (2006.01)

(52) U.S. Cl. ..... 323/280

(58) Field of Classification Search ..... 323/280, 323/281, 316

See application file for complete search history.

(56) References Cited

U.S. PATENT DOCUMENTS 6,275,399 B1 * 8/2001 Miyazaki et al. ..... 363/98
6,600,299 B1 * 7/2003 Xi ..... 323/280

* cited by examiner

*Primary Examiner*—Shawn Riley
(74) *Attorney, Agent, or Firm*—Birch, Stewart, Kolasch & Birch, LLP

(57) ABSTRACT

This invention relates to a quick-recovery low dropout linear regulator (LDO), which utilizes a current-detection circuit to detect the magnitude of the output current, and the output current compares with a reference current so as to dynamically adjust the bias-current of the 2nd stage amplifier such that the system remains stable even when the output current is high resulting from the damping ratio ζ is still greater than 1. As a result, the output voltage can quickly recover stability from a large and sudden change of the output current.

7 Claims, 7 Drawing Sheets

QUICK-RECOVERY LOW DROPOUT LINEAR REGULATOR

FIELD OF THE INVENTION

The present invention relates to a quick-recovery low dropout linear regulator (LDO), more particularly to a low dropout linear regulator that the output voltage can quickly recover to stability from a large and sudden change of the output current.

BACKGROUND OF THE INVENTION

In the age where the communication market is gradually developing, applications of related IC are growing continuously. Together with the development of portable products such as cell-phones, the utility duration for a battery becomes increasingly important. However, to improve the efficiency while maintaining the stability of a battery is challenging topics. Due to the improvement of the converting efficiency and characteristics of small volume and low noise, low dropout linear regulators (LDO) have become the main stream of low-power dropout and regulation circuits in recent years. They are largely used for communication-related electronic products and various portable systems that are powered by batteries.

Among the existing products (methods), the three-stage operation amplifiers in series are commonly adopted to increase its gain for the purpose of improving the accuracy of low dropout linear regulators, however, such adoption always result in instability. Therefore, various frequency-compensation methods are proposed to increase the systems stability. In the beginning, a large capacitance is used for lowering the position of the dominant pole and to increase the phase margin. However, such circuit has the following drawbacks:

Since the main pole of this circuit falls on the output point, a larger load-capacitance is required to stabilize the system. Nevertheless, it is not easy to integrate the said capacitor into a chip, which increases the difficulty of the system integration.

Generally speaking, a larger system gain is used to promote the system accuracy, but the gain promotion degrades the system stability at the same time. Consequently, either accuracy or stability will have to be sacrificed.

The magnitude of the output current is restricted by the system stability. The larger the output current is, the smaller the load-resistance is, and therefore the dominant pole located at the output point becomes larger correspondingly, which degrades the system stability.

The corresponding first non-dominant pole is lower due to the non-dominant pole of this circuit locates at the output point of the operation amplifier (generally, high impedance). Hence, the system bandwidth is narrower and the transient response is worse.

Therefore, for improving the abovementioned drawbacks, various frequency-compensation methods are continuously proposed, such as nest-type Miller compensation, damping ratio ζ control . . . etc. However, each of these methods needs two compensation capacitors, and the used area of the chip is relatively larger than the area used for the simple Miller compensation method. Consequently, the unitary Miller compensation using gain amplification was proposed latterly. Please refer to FIG. 1, although this method successfully solves the abovementioned problem whereas the damping ratio ζ is affected by the output current such that the stabilization speed of the output voltage is slow down.

Please refer to FIG. 2, which is the small-signal model for FIG. 1. In FIG. 2, gm1, gm2, and gmp are the conductance for the first, the second, and the output stage respectively; g01, g02, and g0L are the output-conductance for the first, the second, and the output stage respectively; Cp1 and Cp2 are the input-parasitic capacitances for the second and the output stage respectively. Cout is the load-capacitance; Re is the parasitic resistance for the load-capacitance; Cm1 and Rm are the compensation capacitance and the compensation resistance respectively; Adc is the DC gain of the system; ζ is the damping ratio. According to the small-signal model of FIG. 2, the transfer function of the system is derived as follow:

$$Av(s) = \frac{A_{dc}(1 + SC_{out}R_e)\left[1 + SC_{m1}\left(R_m - \frac{g_{o2}}{g_{m2}g_{mp}}\right) - S^2\frac{C_{m1}C_g}{g_{m2}g_{mp}}\right]}{\left(1 + \frac{S}{P_{-3db}}\right)\left(1 + SC_{out}\left(R_e + \frac{g_{o2}}{g_{m2}g_{mp}}\right) + S^2\frac{C_gC_{out}}{g_{m2}g_{mp}}\right)} \quad (1)$$

where $$A_{dc} = \frac{g_{m1}g_{m2}g_{mp}}{g_{o1}g_{o2}g_L},\ P_{-3db} = \frac{C_{m1}g_{m2}g_{mp}}{g_{o1}g_{o2}g_L}.$$

$$\zeta = \frac{1}{2}C_{out}\left(R_e + \frac{g_{o2}}{g_{m2}g_{mp}}\right)\sqrt{\frac{g_{m2}g_{mp}}{C_gC_{out}}} \xrightarrow{\text{for small ESR}} \approx \frac{1}{2}g_{o2}\sqrt{\frac{C_{out}}{g_{m2}g_{mp}C_g}} \quad (2)$$

$$\alpha\sqrt{\frac{I_{b2}}{g_{mp}}} \quad (3)$$

$$\left(gm2 = \frac{I_{b2}}{V_{gs2} - V_{th2}},\ go2 = \lambda Ib2\right)$$

For reducing the cost, the recent market tends to use cheaper capacitors such as ceramic capacitors as the load-capacitors. Because the parasitic resistance of a ceramic capacitor is smaller, so Eq. (2) can be simplified to Eq. (3).

Knowing from Eq. (3), the damping ratio ζ is inverse-proportional to the conductance of the output stage (gmp), and is proportional to the bias current of the 2nd stage amplifier (Ib2). Since the conductance of the output stage (gmp) getting larger (approximately 30 times) if the output current getting larger (eg. from 0.1 mA to 150 mA), the damping ratio ζ decrease to become smaller than 1 (or even far smaller than 1). Accordingly, the frequency response has a surge around the unit-gain frequency, which leads to a ripple on the transient response of the output voltage Vout when the output current suddenly changes such that the stabilization speed of the output voltage is slow down. As a result, it cannot provides a quick-recovery low dropout linear regulator.

SUMMARY OF THE INVENTION

Consequently, the main purpose of the current invention is to dynamically adjust the bias current of the 2nd stage amplifier so as to compensate the affection of the damping ratio ζ due to the variation of the output current, and to eliminate the surge of the frequency response and to expedite the stabilization speed of the output voltage.

The present invention is a quick-recovery low dropout linear regulator, which has a low dropout linear regulator circuit with a gained-amplification unitary Miller compensation capacitor. The low dropout linear regulator circuit has a 2nd stage amplifier and an output current for the use of the load, which is composed of a current-detection circuit, a comparator circuit, a control element, and a voltage-pumping circuit. The current-detection circuit is used to detect the magnitude of the output current of the compensation circuit so as to output a corresponding comparison current; the comparator circuit compares the two input signals of the comparator circuit, which are the comparison current and a fixed reference current, so as to generate a comparison signal; the control element is controlled by the comparison signal and outputs a control signal; the voltage-pumping circuit is used to change the bias current of the 2nd stage amplifier. The voltage-pumping circuit receives the control signal of the control element to decide that the bias current of the 2nd stage amplifier should be changed or not. According to this, if the comparison current is greater than the reference current the comparator outputs the comparison signal to control the voltage-pumping circuit to increase the bias current of the 2nd stage amplifier so as to cancel the affection of the damping ratio ζ due to the variation of the output current, and to eliminate the surge of the frequency response and to expedite the stabilization speed of the output voltage.

DETAILED DESCRIPTION OF THE PREFERRED EMBODIMENTS

The detailed descriptions for content and technology of this invention associate with figures are as follows.

Figure 1:
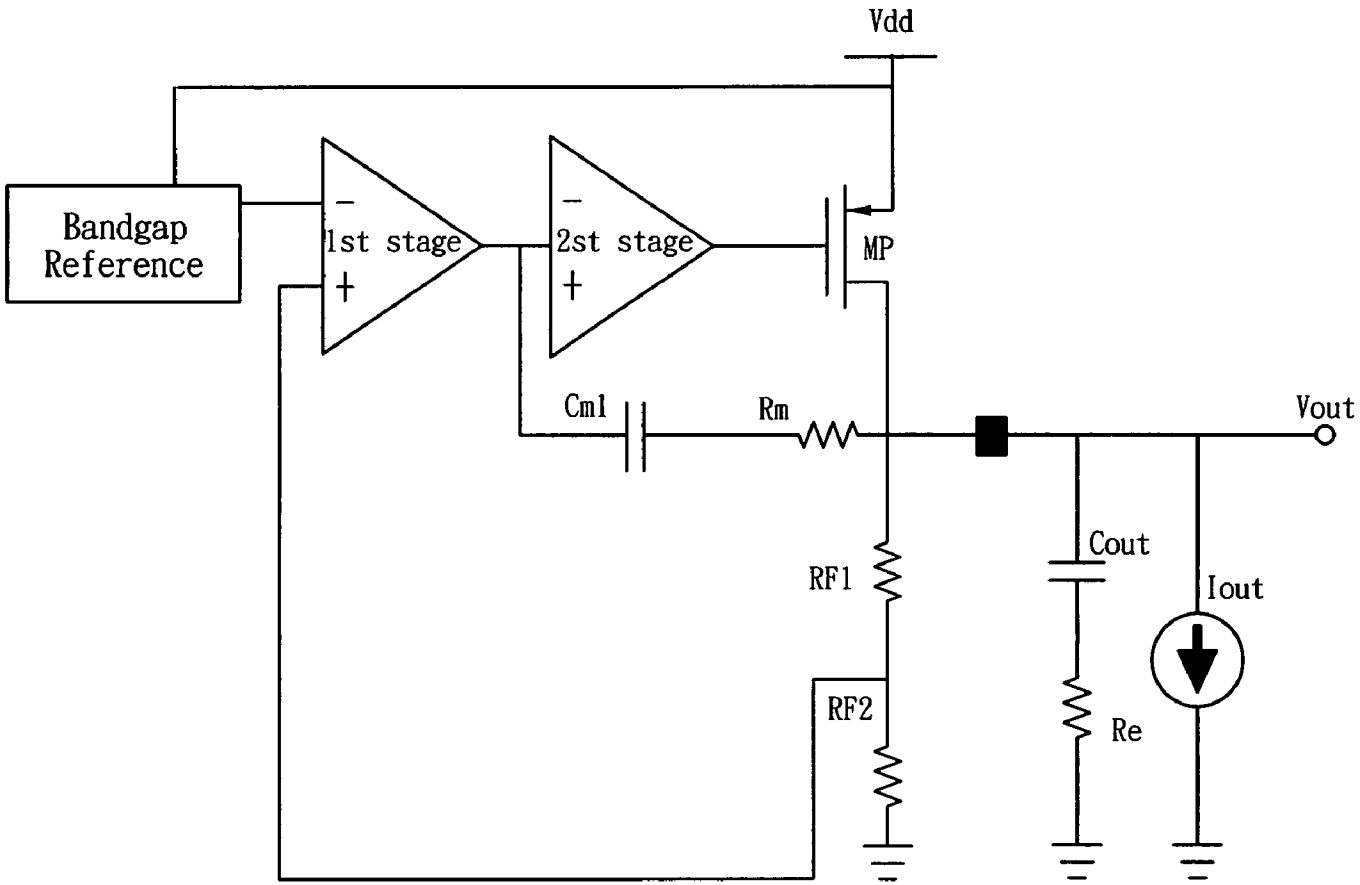
Fig. 1 PRIOR ART
FIG. 1 is a conventional low dropout linear regulator.
Figure 2:
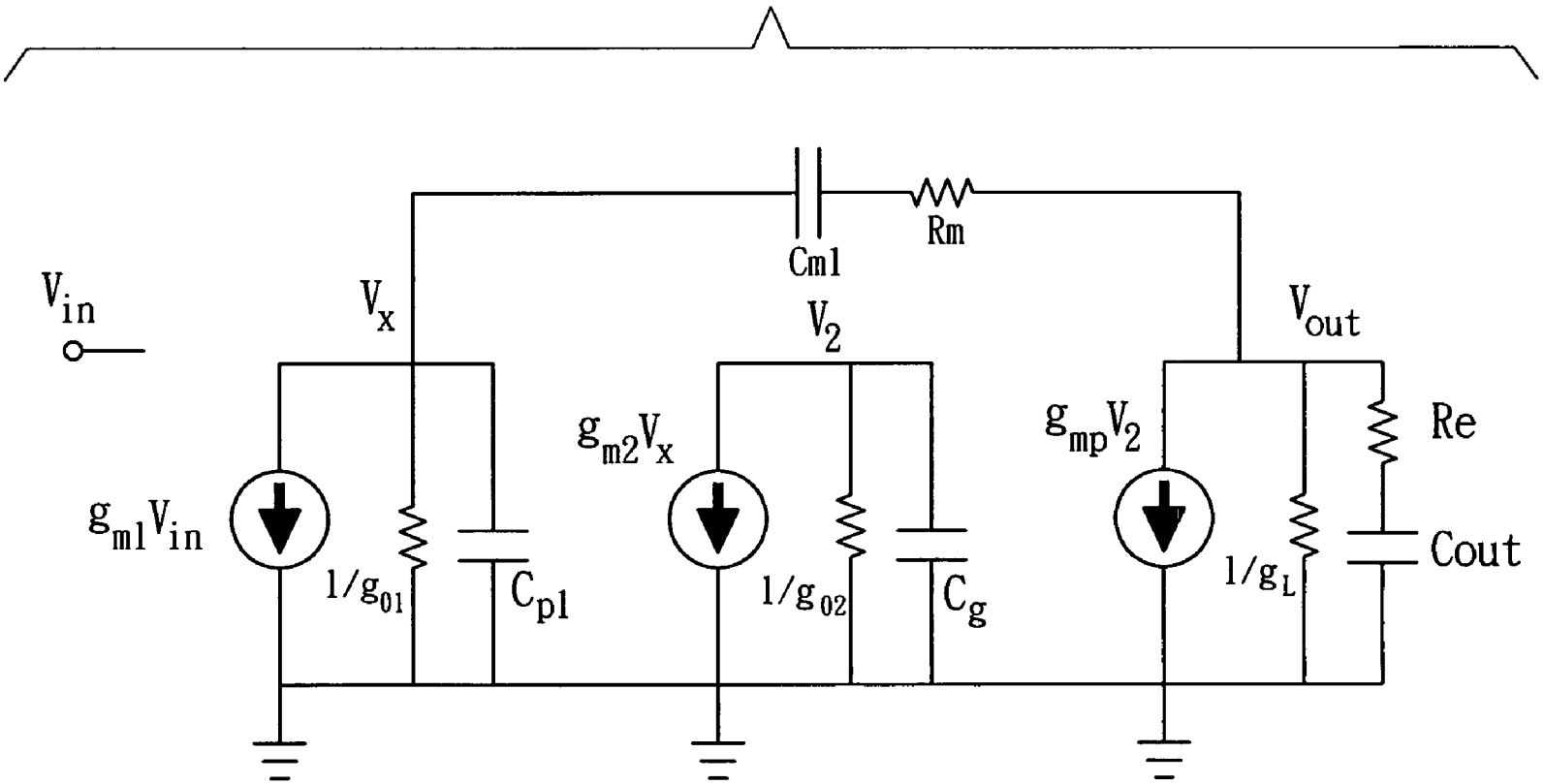
Fig. 2 PRIOR ART
FIG. 2 is the small-signal model for FIG. 1.
Figure 3:
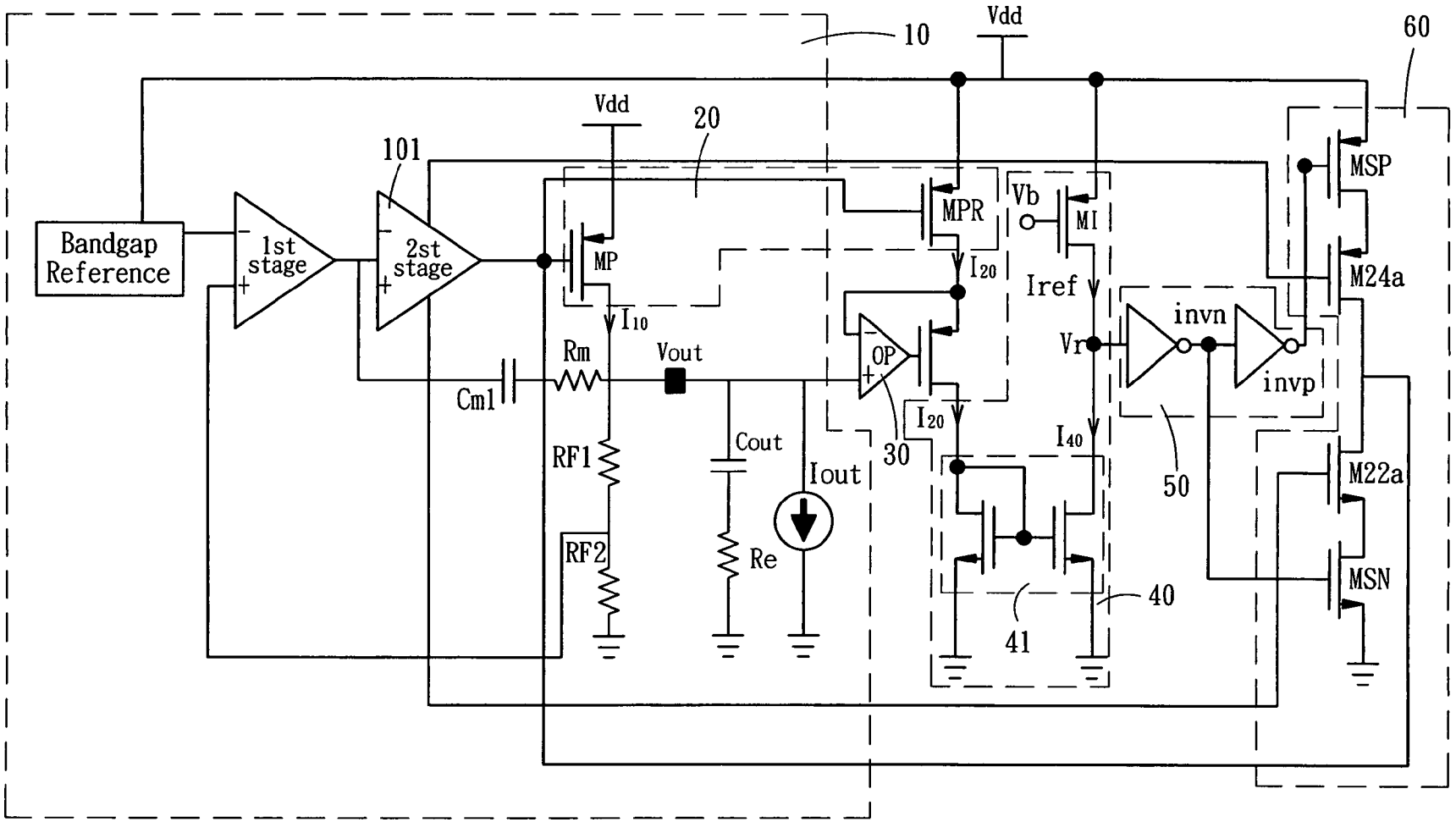
FIG. 3 is the system circuit diagram of the present invention.

Please refer to FIG. 3, which is the system circuit diagram of the present invention. The circuit includes a low dropout linear regulator circuit 10 with a gained-amplification unitary Miller compensation capacitor. The needed deriving voltage is supplied by a high-level supply voltage Vdd. The low dropout linear regulator circuit 10 has a 2nd stage amplifier 101 and an output current I10 to supply the use of a load. Using the current mirror theorem that adopts two transistors MP and MPR to form a current detection circuit 20, and an amplifier 30 is used to form a negative feedback mechanism so as to accurately detect the output current I10 of the low dropout linear regulator circuit 10 and outputs a corresponding comparison current I20. For reducing the load and consumption of the circuit, the magnitude of the comparison current I20 can be diminished in multiple such as letting I20=I10/K; where K is decided by the characteristics of transistors MP and MPR.

The comparator 40 compares the comparison current I20 with the fixed reference current Iref and then outputs a comparison signal. The reference current Iref is produced by the two high-level supply voltages Vdd and Vb and the transistor MI. The comparator 40 is composed of the 1:1 NMOS current mirror 41, and the two inputs are the comparison current I20 and the reference current Iref. The comparator 40 has a high impedance point Vr whose two terminals are the reference current Iref and the equivalent current I40 generated by the 1:1 NMOS current mirror 41 according to the comparison current I20, respectively. By way of measuring the current variation of the high impedance point Vr can compare the currents and generate the comparison signal.

The comparison signal is used to feed the control element 50 so as to generate a control signal. The control element 50 is composed of two inverters invn and invp that are connected in series. The control element 50 connects to the high impedance point Vr such that the comparison signal generated by the current variation of the high impedance point Vr passes through the two series inverters invn and invp to produce a 0 or 1 control signal of the (invn, invp).

The control signal is used to control the voltage-pumping circuit 60, and the voltage-pumping circuit 60 is used to change the bias current of the 2nd stage amplifier 101. The voltage-pumping circuit 60 is composed of transistors MSP, M24*a*, M22*a*, and MSN. The control signal controls the conduction of transistors MSP and MSM or not to increase the bias current of the 2nd stage amplifier 101.

Before this invention operates, the magnitude of the reference current Iref has to be determined. The best-design value for the reference current Iref relates to the output current I10 that is obtained when the system damping ratio ζ is smaller than 1. If the magnitude of the output current I10 is A, the system damping ratio ζ will be smaller than 1 and the value of the reference current Iref can be set as A/K.

The operation of this invention can be divided into two states. First, when the output current I10 is at light-load output, the system damping ratio ζ is greater than 1 and the comparison current I20 (=I10/K) is smaller than the reference current Iref. At this time, the control signal of the two series inverters of the control element 50 is (invn:0, invp:1), which opens transistors MSP and MSN hence the bias current of the 2nd stage amplifier 101 does not increase. However, the system damping ratio ζ is still greater than 1 now, the output voltage Vout of the output current I10 can be stable in a short time even there is no compensation.

When the load of the output current I10 becomes heavy, the output current I10 becomes large, the system damping ratio ζ is getting small, and the output voltage Vout of the output current I10 is becoming unstable and ripple appears. At the instant of the comparison current I20 is greater than the reference current Iref, the control signal of the two series inverters invn and invp of the control element 50 becomes (invn:1, invp:0), which turns transistors MSP and MSN on hence the bias current of the 2nd stage amplifier 101 increases. Besides, because the system damping ratio ζ is proportional to the bias current of the 2nd stage amplifier 101, so this invention increases the bias current of the 2nd stage amplifier 101 to compensate the affection of the damping ratio ζ due to the output current I10, and the damping ratio keeps at a suitable value (greater than 1). Therefore, when the load of the output current I10 changes from light (eg. 0.1 mA) to heavy (eg. 150 mA), the output voltage Vout of the output current I10 also can be stable in a short time.

Figure 4:
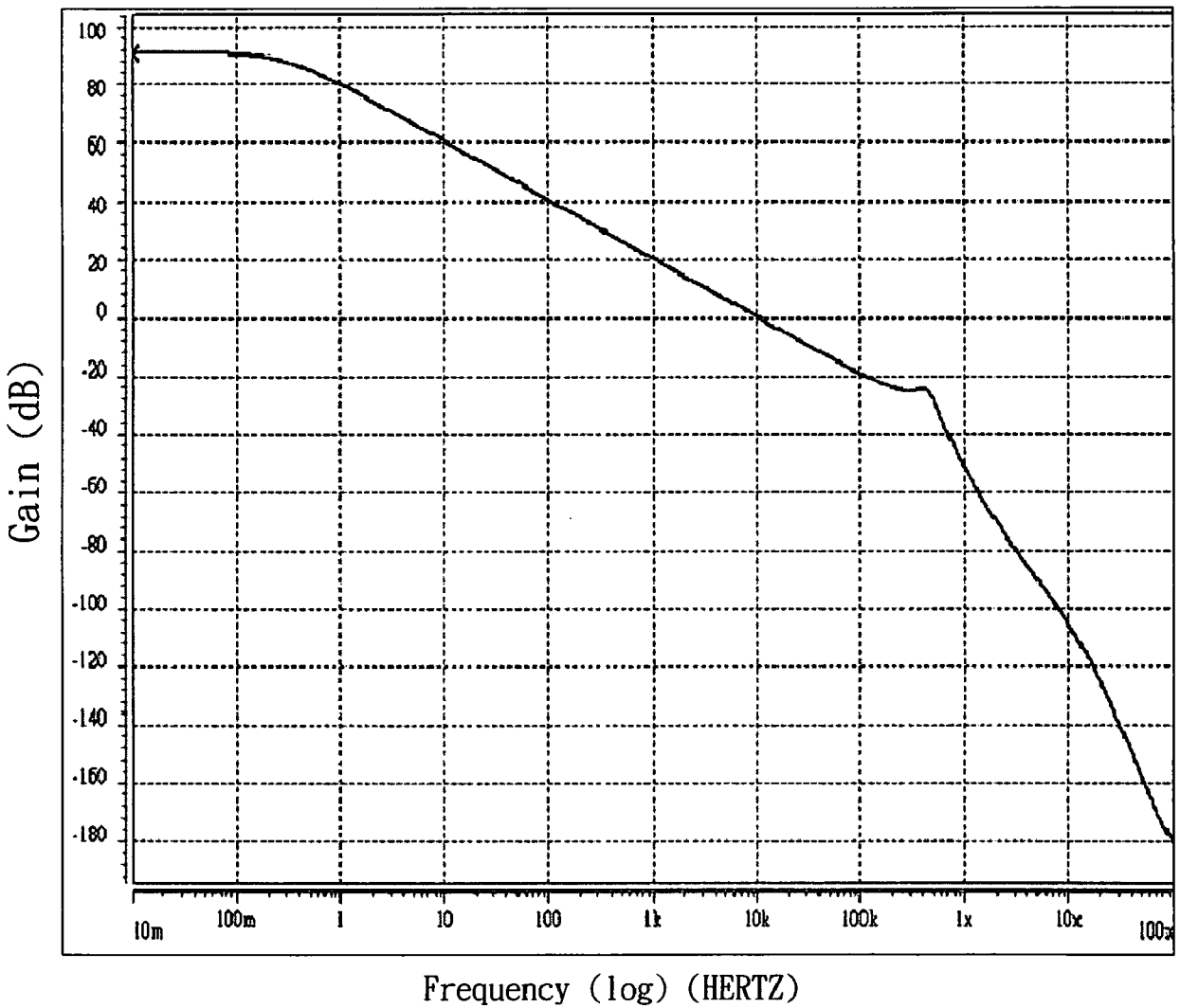
FIG. 4 is the frequency response diagram before the compensation of the present invention.
Figure 5:
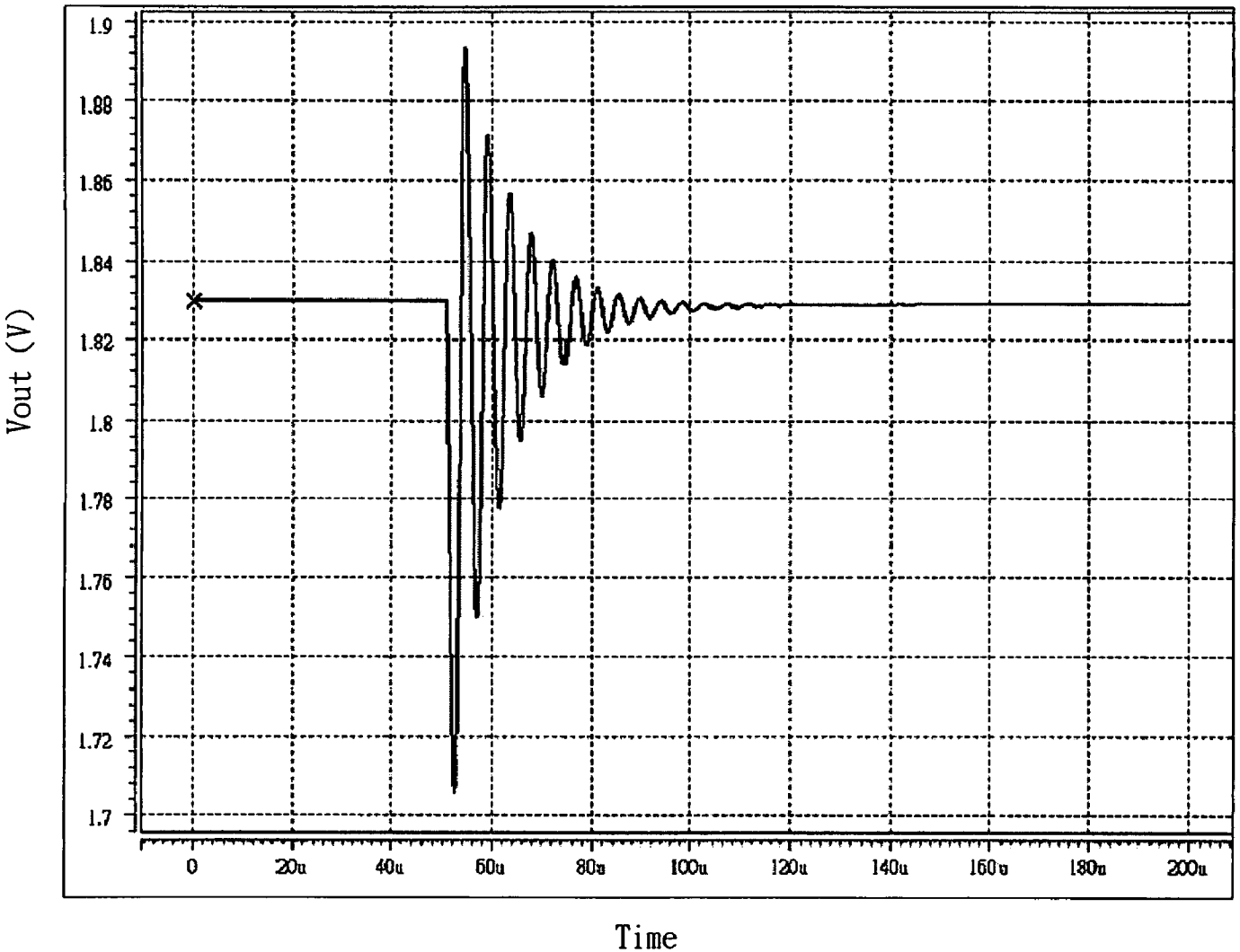
FIG. 5 is the transient response diagram before the compensation of the present invention.

Please refer to FIGS. 4 and 5, which are the frequency response diagram and transient response diagram of the low dropout linear regulator circuit 10 before the compensation respectively. As shown in FIG. 4, it is obvious to see that when the load of the output current I10 is heavy, a surge occurs around the unity gain frequency of the frequency response diagram. It is the reason why there are some ripples in FIG. 5 such that the stabilization time for the output voltage Vout is 34 μs.

Figure 6:
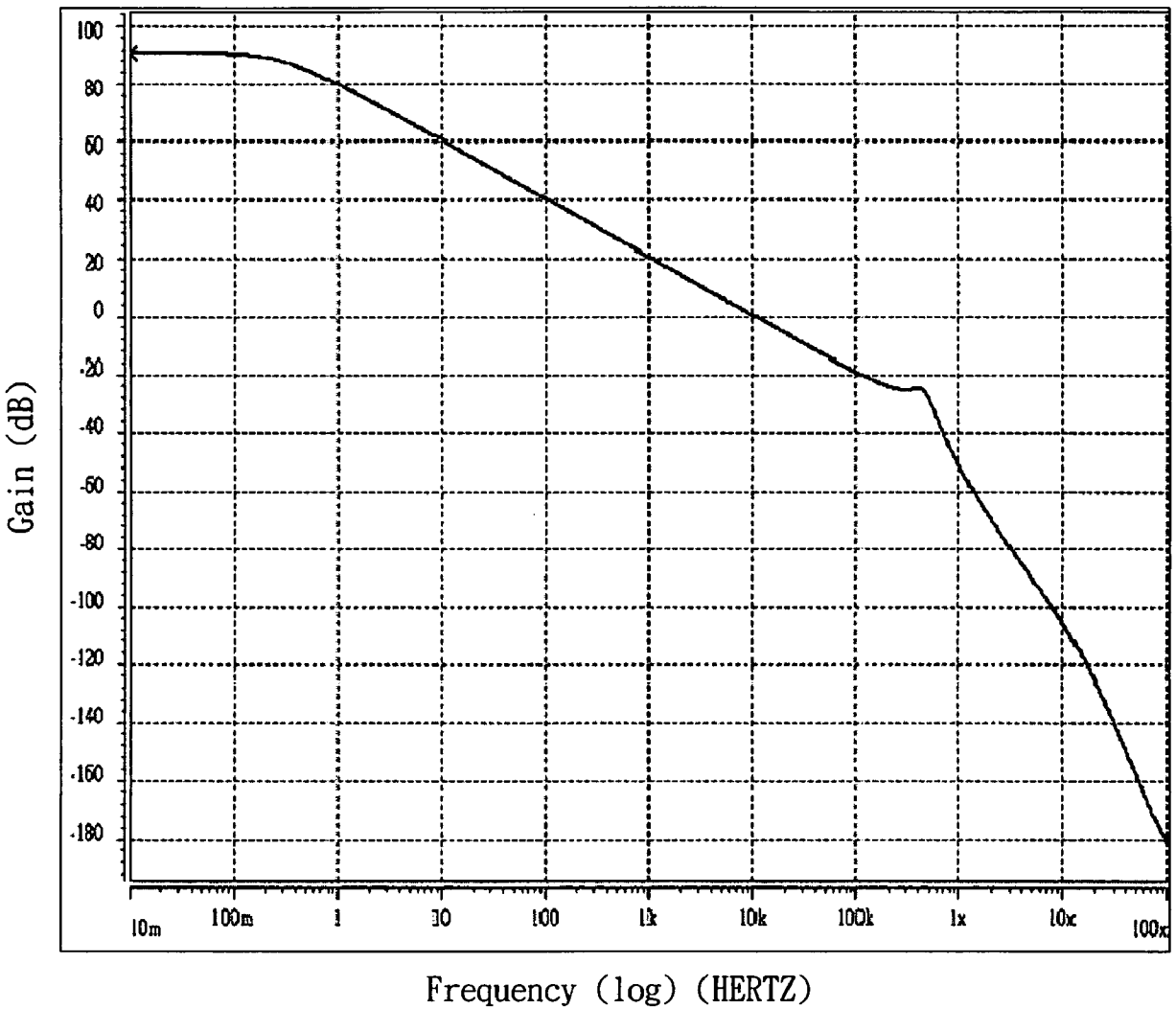
FIG. 6 is the frequency response diagram after the compensation of the present invention.
Figure 7:
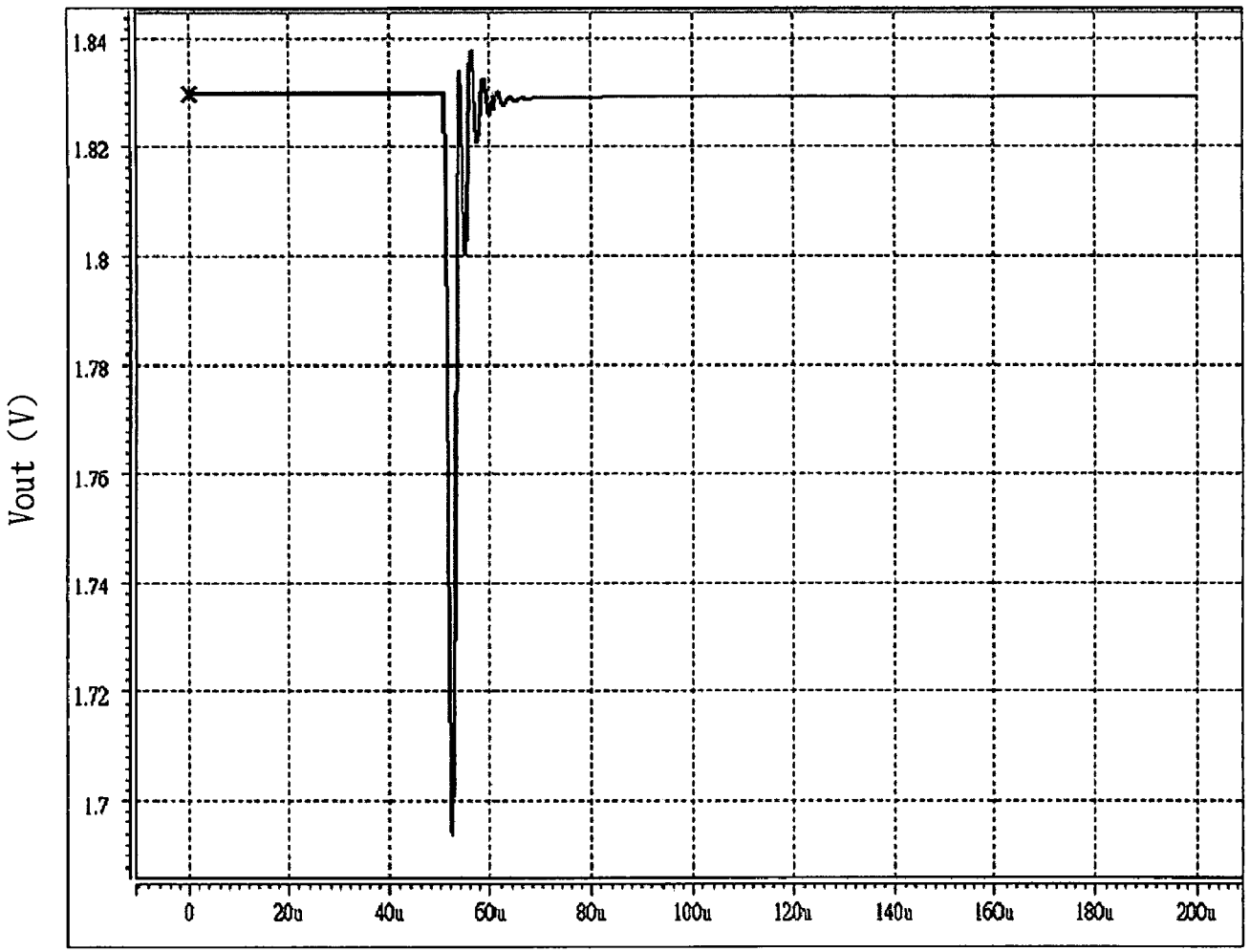
FIG. 7 is the transient response diagram after the compensation of the present invention.

Please further refer to FIGS. 6 and 7, which are the frequency response diagram and transient response diagram of the low dropout linear regulator circuit 10 after the compensation respectively. As shown in FIG. 6, there is no surge around the unity gain frequency. That is the reason why ripples are reduced in FIG. 7 such that the stabilization is achieved quickly (approximately 8 μs). Therefore, when the load of the output current I10 changes to heavy in this invention, the output voltage Vout of the output current I10 still can recover to be stable in a short time.

What is claimed is:

1. A quick-recovery low dropout linear regulator, having a low dropout linear regulator circuit with a gained-amplification unitary Miller compensation capacitor, wherein said low dropout linear regulator circuit has a 2nd stage amplifier and an output current for the use of the load, comprising:

a current-detection circuit, wherein the current-detection circuit is used to detect the magnitude of the output current of the low dropout linear regulator to output a comparison current;

a comparator circuit, wherein the comparator circuit compares a comparison current and a fixed reference current to generate a comparison signal;

a control element, wherein the control element is controlled by the comparison signal and outputs a control signal;

a voltage-pumping circuit, wherein the voltage-pumping circuit is used to change bias current of the 2nd stage amplifier and receives the control signal of the control element to adjust the bias current of said 2nd stage amplifier; if the comparison current is greater than the reference current, the comparator circuit outputs the comparison signal to control the voltage-pumping circuit to increase the bias current of the 2nd stage amplifier.

2. The quick-recovery low dropout linear regulator as claimed in claim 1, wherein the current-detection circuit is composed of current mirror circuit.

3. The low dropout linear regulator as claimed in claim 2, further comprising an amplifier, wherein said amplifier and the current-detection circuit form a negative feedback mechanism.

4. The quick-recovery low dropout linear regulator as claimed in claim 1, wherein the comparator circuit is composed of 1:1 NMOS current mirror, and two inputs of the comparator circuit are the comparison current and the reference current; the comparator circuit has a high impedance point whose two terminals are the reference current and the current generated by the 1:1 NMOS current mirror according to the comparison current, where current comparison can be achieved by measuring the current variation of the high impedance point.

5. The quick-recovery low dropout linear regulator as claimed in claim 1, wherein the control element is composed of two inverters that are connected in series to produce a 0 or 1 control signal of the (invn, invp).

6. The quick-recovery low dropout linear regulator as claimed in claim 1, wherein the voltage-pumping circuit is composed of transistors and the bias current of the 2nd stage amplifier can be adjusted by using the control signal to control the conduction of transistors.

7. The quick-recovery low dropout linear regulator as claimed in claim 1, wherein the magnitude of the comparison current is diminished in multiple of the output current.

* * * * *